US005201289A

United States Patent [19]

Imai

[11] Patent Number: 5,201,289

[45] Date of Patent: Apr. 13, 1993

[54] VALVE TIMING CONTROL SYSTEM FOR INTERNAL COMBUSTION ENGINE

[75] Inventor: Hiroaki Imai, Kanagawa, Japan

[73] Assignee: Atsugi Unisia Corporation, Atsugi, Japan

[21] Appl. No.: 937,273

[22] Filed: Aug. 31, 1992

[30] Foreign Application Priority Data

Aug. 30, 1991 [JP] Japan ..... 3-069565[U]

[51] Int. Cl.[5] ..... F01L 1/34

[52] U.S. Cl. ..... 123/90.17; 123/90.31; 464/2; 74/568 R

[58] Field of Search ..... 123/90.15, 90.17, 90.31; 464/2, 160; 74/567, 568 R

[56] References Cited

U.S. PATENT DOCUMENTS

| | | | |
|---|---|---|---|
| 4,535,731 | 8/1985 | Banfi | 123/90.15 |
| 4,787,345 | 11/1988 | Thoma | 123/90.17 |
| 4,895,113 | 1/1990 | Speier et al. | 123/90.17 |
| 5,012,774 | 5/1991 | Strauber et al. | 123/90.17 |
| 5,088,456 | 2/1992 | Suga | 123/90.17 |
| 5,138,985 | 8/1992 | Szodfridt et al. | 123/90.17 |

*Primary Examiner*—E. Rollins Cross
*Assistant Examiner*—Weilun Lo
*Attorney, Agent, or Firm*—Foley & Lardner

[57] ABSTRACT

A valve timing control system includes a timing sprocket, a camshaft, a sleeve secured to the camshaft and accomodated within the timing sprocket. A helical piston assembly and a floating piston are movably disposed in an annular space between the timing sprocket and the sleeve. An end plug is disposed at one end of the timing sprocket to close one end of the annular space. First and second chambers are defined between the floating piston and the end plug and between the floating piston and the helical piston assembly, respectively. A valve spool is operatively connected to an actuator and movably disposed in the sleeve. The valve spool moves among first, second and third positions. At the first position, the first and second chambers are drained. At the second position, the first chamber is communicated with a hydraulic fluid pump and the second chamber is drained. At the third position, the first and second chambers are communicated with the hydraulic fluid pump.

2 Claims, 6 Drawing Sheets

VALVE TIMING CONTROL SYSTEM FOR INTERNAL COMBUSTION ENGINE

BACKGROUND OF THE INVENTION

The present invention relates to a valve timing control system for an internal combustion engine, and more specifically to a valve timing control system capable of promptly and reliably adjusting angular phase relationship between the engine crankshaft and a camshaft in response to variation in load condition of an internal combustion engine.

U.S. Pat. No. 4,535,731 issued on Aug. 20, 1985 to Banfi and U.S. Pat. No. 5,088,456 issued on Feb. 18, 1992 to Suga disclose a valve timing control system for an internal combustion engine. The valve timing control system includes a cylindrical outer rotary member rotatable with a timing sprocket that is driven via a timing belt or chain by a crankshaft of an engine. The valve timing control system also includes a cylindrical inner rotary member disposed within the outer rotary member and fixedly connected to the camshaft and a helical piston disposed between the outer and inner rotary members. An angular phase relationship between the inner and outer rotary members is variable with an axial motion of the helical piston owing to a hydraulic pressure acting thereon.

Specifically, the valve timing control system disclosed in the U.S. Pat. No. 5,088,456 includes a floating piston movably disposed between the inner and outer rotary members and defining first and second chambers on its both sides. A valve spool movably disposed in the inner rotary member cooperates with a two-position solenoid operated flow control valve connected to a hydraulic fluid source, for selectively draining or communicating the first and second chambers with the hydraulic fluid source. When the engine load varies from a medium level to a high level, the first chamber is drained while the second chamber defined between the floating piston and the helical piston is supplied with a hydraulic fluid. Therefore, when the second chamber is expanded upon introduction of the hydraulic fluid thereinto, the floating piston is allowed to move remote from the helical piston. This leads to the deficiency that the hydraulic pressure exerted on the helical piston is not sufficiently large for quick motion of the helical piston.

Thus, the valve timing control system includes the two-position solenoid operated flow control valve and the two-position solenoid operated spool valve, resulting in the complicated structure and operational steps.

An object of the present invention is to provide a valve timing control system which a shift is made quickly.

SUMMARY OF THE INVENTION

Accordingly, the present invention provides a valve timing control system comprising a timing sprocket which includes a cylindrical body, a camshaft and a sleeve which is secured to the camshaft. The sleeve is disposed in the cylindrical body of the timing sprocket and cooperates with the cylindrical body and the camshaft to define an annular space therebetween. A helical piston assembly is movably disposed in the annular space. A floating piston is movably disposed in the annular space. An end plug closes one end of the annular space. The floating piston and the end plug cooperate with each other to define therebetween a first chamber in the annular space. The floating piston and the piston assembly cooperate with each other to define therebetween a second chamber in the annular space. The valve timing control system also includes means for causing the sleeve to vary an angular position thereof relative to the cylindrical body in response to movement of the helical piston assembly. There is also provided a hydraulic fluid pump. A valve spool is movably disposed in the sleeve. The valve spool has a first position wherein the first and second chambers are drained, a second position wherein the first chamber is allowed to communicate with the hydraulic fluid pump to be supplied with pressurized hydraulic fluid and the second chamber is drained, and a third position wherein the first and second chambers are allowed to communicate with the hydraulic fluid pump to be supplied with the pressurized hydraulic fluid. An actuator is operatively connected to said valve spool for movement of the valve spool among the first, second and third positions.

DESCRIPTION OF THE PREFERRED EMBODIMENT

Figure 1:
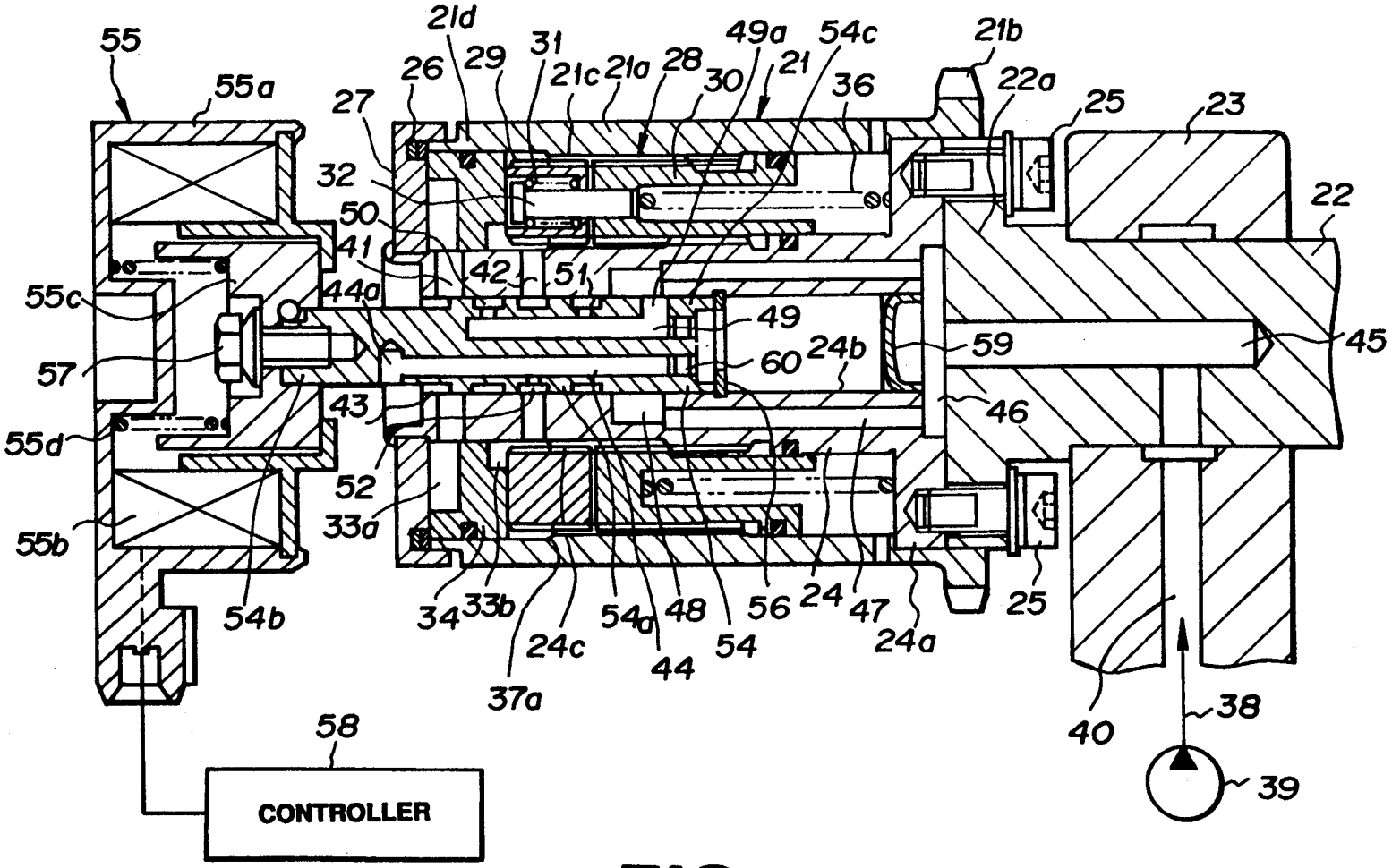
FIG. 1 is a sectional view of one preferred embodiment of a valve timing control system according to the present invention.

Referring now to the drawings, the preferred embodiment of a valve timing control system according to the invention is disclosed. As shown in FIG. 1, a valve timing control system comprises a timing sprocket 21 and a camshaft 22 rotatably supported by a cam bearing 23 of the engine cylinder head (not shown). The camshaft 22 has, at one axial end thereof, a flange **22*a* to which a flange 24*a* of a sleeve 24 is secured by means of fastening bolts 25. The sleeve 24 is formed with external teeth 24*c***.

Mounted on these jointed flanges **22*a* and 24*a* is a timing sprocket 21. The timing sprocket 21 has a cylindrical body 21*a* extending as the sleeve 24 does from the joined flanges 22*a* and 24*a*. An annular space is defined between an inner circumferential surface of the timing sprocket 21 and an outer circumferential surface of the sleeve 24. The flange 24*a* closes one end of the annular space. The timing sprocket 21 has a gear 21*b* on rear (right in FIG. 1) end of the body 21*a*. Via a timing chain (not shown), the gear 21*b* is operatively connected to a crankshaft (not shown). The body 21*a* of the timing sprocket 21 is formed with an internal teeth 21*c***.

In the annular space defined between the timing sprocket 21 and the sleeve 24 is disposed a helical piston assembly 28 comprising two gear elements 29 and 30. The gear elements 29 and 30 are interconnected by means of a connecting pin 32 in such a manner that the gear element 29 is slidable on the connecting pin 32 fixed to the gear element 30. The gear element 29 is normally urged rearward (rightward in FIG. 1) by a spring 31 so as to abut against the gear element 30. On both of inner and outer circumferential surfaces of the gear elements 29 and 30, helical teeth are formed. The outer helical teeth on the outer surfaces of the helical piston assembly 28 mesh with the internal teeth 21c of the timing sprocket 21. The inner helical teeth on the inner surfaces of the helical piston assembly 28 mesh with the external teeth 24c of the sleeve 24. A coil spring 36 is disposed between the gear element 30 and the flanged end 24a of the sleeve 24 to urge the helical piston assembly 28 in a forward direction (leftward viewing in FIG. 1).

A floating piston 34 is slidably disposed within the annular space opposite to the helical piston assembly 28. Opposed to the remote axial end of the floating piston 34 to the helical piston assembly 28 is an annular end plug 27 for closing the other end of the annular space. The end plug 27 is fixedly fitted to an axial end portion of the sleeve 24 by caulking. As a result, axial movement of the floating piston 34 in the forward direction (leftward viewing in FIG. 1) is limited by this end plug 27.

The end plug 27 has on its outer periphery an axial flange engaging an axial end 21d of the cylindrical body 21a of the timing sprocket 21. Formed adjacent the axial flange is a groove in which a seal 26 is disposed to seal an inner space of the timing sprocket 21. As a result, the end plug 27 is rotatable together with the sleeve 24 relative to the timing sprocket 21. An axial end of the gear element 30 is opposed to the flange 24a of the sleeve 24 so that a rearward (rightward viewing in FIG. 1) axial motion of the helical piston assembly 28 is limited upon abutting the flange 24a of the sleeve 24. The floating piston 34 has an outer diameter larger than that of the helical piston assembly 28. The rearward axial motion of the floating piston 34 is limited by a shoulder 37a which is formed on the inner surface of the cylindrical body 21a of the timing sprocket 21.

The helical piston assembly 28 and the floating piston 34 cooperate with each other to define a first chamber 33a and a second chamber 33b in the annular space. The first chamber 33a is defined between the end plug 27 and the floating piston 34, while the second chamber 33b is defined between the gear element 29 of the helical piston assembly 28 and the floating piston 34.

A fluid pump 39 is connected via an oil main gallery 38 to a main supply bore 40 radially extending through the cam bearing 23 and communicating with an axial bore 45 axially extending through the camshaft 22. The axial bore 45 is connected to a central shallow bore 46 formed in the flange 24a of the sleeve 24. The central shallow bore 46 communicates with a passage 47 formed through the sleeve 24, which axially extends up to a substantially mid-portion of the sleeve 24. Communication between the central shallow bore 46 and a center bore 24b of the sleeve 24 is blocked by a blind plug 59. The passage 47 communicates with an inner annular groove 48 formed in an inner circumferential surface of the sleeve 24. First and second radial bores 41 and 42 have their inner ends communicating with the center bore 24b of the sleeve 24 and their outer ends communicating with the first and second chambers 33a and 33b, respectively.

A valve spool 54 is slidably disposed in the center bore 24b of the sleeve 24. The valve spool 54 is has one end 54b connected to a solenoid-operated actuator 55. The valve spool 54 is driven by the actuator 55 so as to axially slide in the center bore 24b of the sleeve 24. The other end 54c of the valve spool 54 is opposed to an annular stopper 56 which is fitted into the center bore 24b. Therefore, the stopper 56 limits a rearward (rightward viewing in FIG. 1) axial motion of the valve spool 54. The valve spool 54 includes a drain passage 44. The drain passage 44 has a drain opening 44a. The drain passage 44 extends toward the distal end 54c of the valve spool 54 remote from the actuator 55. A drain port 43 is formed as a shoulder portion of the valve spool 54 adjacent the drain opening 44a of the drain passage 44. The valve spool 54 also includes a supply passage 49 extending in substantially parallel with the drain passage 44. The supply passage 49 has an inlet opening 49a communicating with the inner annular groove 48. Axially spaced grooves 50, 52 and 51 are formed on the valve spool 54. The grooves 50 and 51 communicate with the supply passage 49. Disposed between the grooves 50 and 51 is the groove 52 which communicates with the drain passage 44. A blind plug 60 is disposed between the passages 44 and 49 of the valve spool 54 and the center bore 24b of the sleeve 24 to prevent fluid communication therebetween.

The actuator 55 is of a known current proportional type in which axial motion of the valve spool 54 varies in proportion to electrical current supplied to the actuator 55. The actuator comprises a housing 55a, a core 55c disposed in the housing 55a and an annular coil 55b disposed around the core 55c. The core 55c is urged against the housing 55a by a coil spring 55d and connected with the end 54b of the valve spool 54 by means of a bolt 57. The coil 55b is connected to a controller 58. The controller 58 detects an engine driving condition based on an engine revolution speed signal and a load signal which are transmitted from a crank angle sensor, an air flow meter (neither shown) and the like. Subsequently, the controller 58 transmits a control signal for supplying the actuator 55 with a predetermined electrical current according to results of the detection on the engine driving condition. The actuator 55 drives the valve spool 54 according to the control signal so as to control the axial motion of the valve spool 54.

Figure 2:
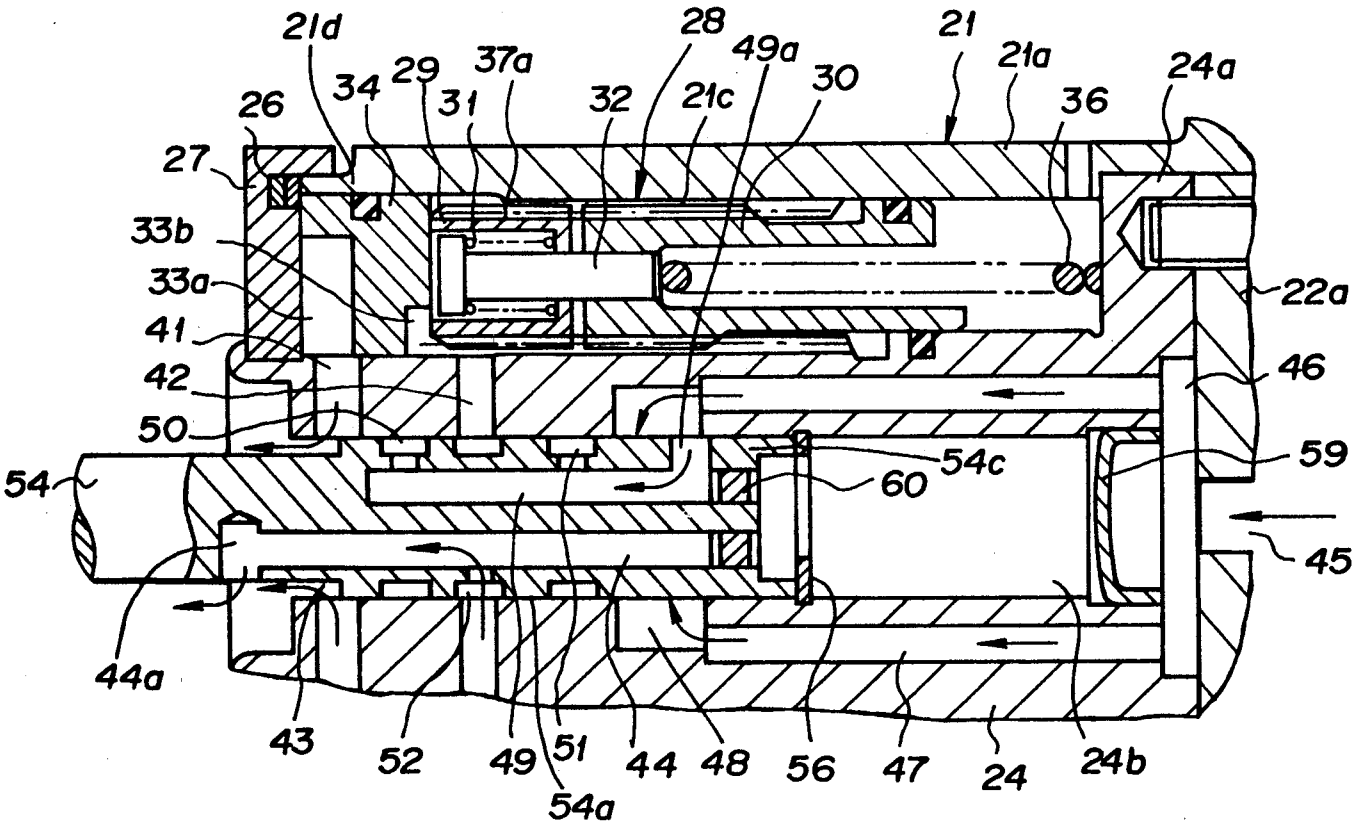
FIG. 2 is an enlarged fragmentary view of FIG. 1, showing an operational state with low engine load.

When OFF signal is transmitted from the controller 58 to the actuator 55 under a low engine load condition, the coil 55b is deenergized to project the valve spool 54 from the housing 55a. Under such a condition, the valve spool 54 is held in the right-most position as viewed in FIGS. 1 and 2. In this position, the valve spool 54 is urged against the stopper 56 due to a force of the coil spring 55d. As seen in FIGS. 1 and 2, the first and second chambers 33a and 33b communicate with the first and second radial bores 41 and 42 of the sleeve 24, respectively. The first radial bore 41 communicates with the drain port 43 of the valve spool 54 while the second radial bore 42 communicates with the groove 52 of the drain passage 44 of the valve spool 54. At this time, the grooves 50 and 51 of the supply passage 49 are closed by the inner surface of the sleeve 24 while the inner annular groove 48 is closed by an outer surface 54a of the valve spool 54. Accordingly, the hydraulic fluid fed via the main supply bore 40 from the fluid pump 39 is not introduced into either of the first and second chambers 33a and 33b. The hydraulic fluid in the first and second chambers 33a and 33b is discharged from the drain port 43 and the drain passage 44, respectively, as shown by arrows in FIG. 2. The hydraulic pressure in the first and second chambers 33a and 33b is reduced so that the helical piston assembly 28 is urged leftward viewing in FIG. 2 by the force of the coil spring 36. At the left-most position of the helical piston assembly 28, the gear element 29 abuts against the end plug 27 through the floating piston 34. At this time, angular phase relationship between the timing sprocket 21 and the camshaft 22 is minimum in one direction such that valve close timing is relatively late.

Figure 3:
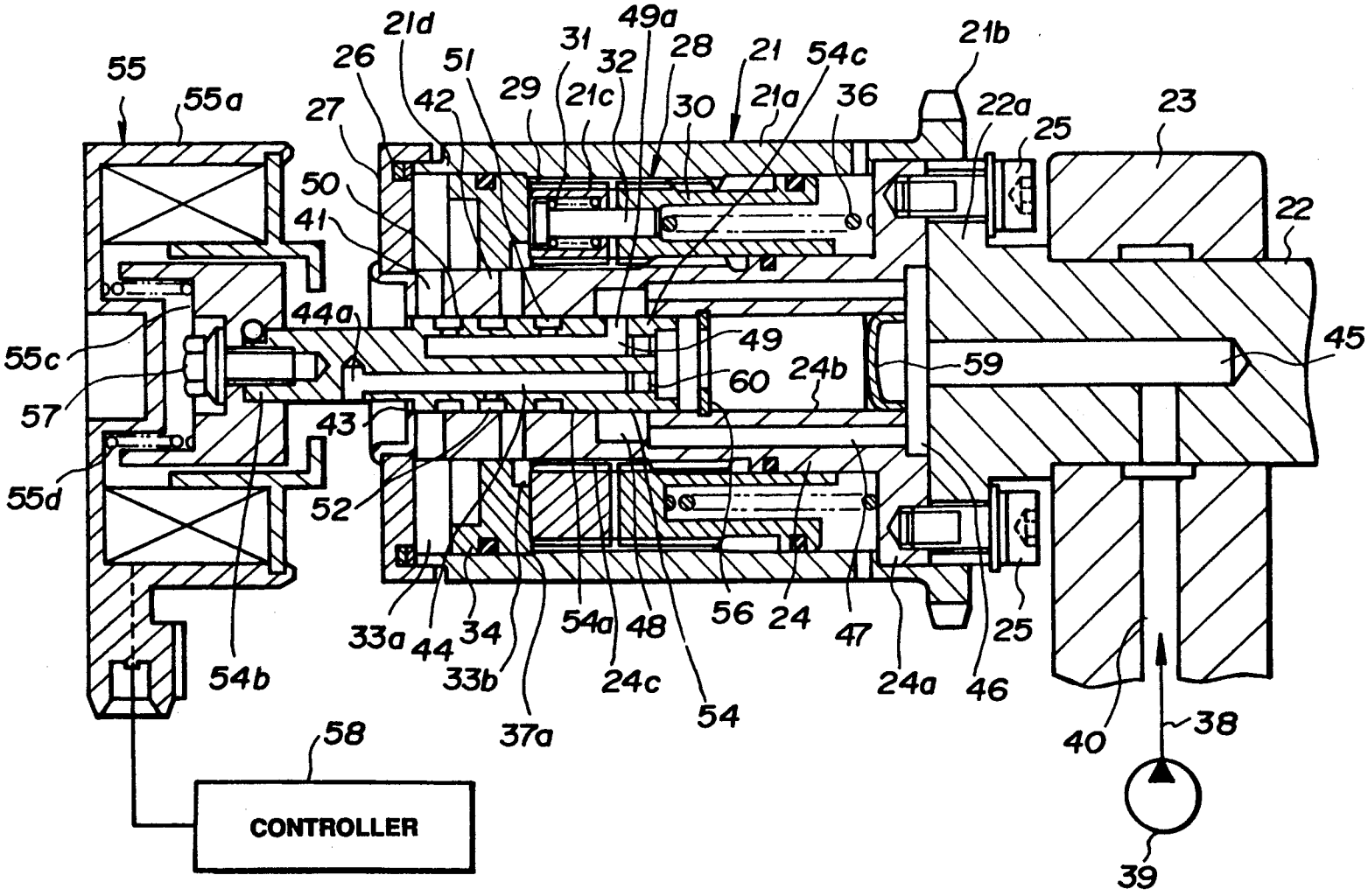
FIG. 3 is an enlarged section of the valve timing control system, showing an operational state with medium engine load.
Figure 4:
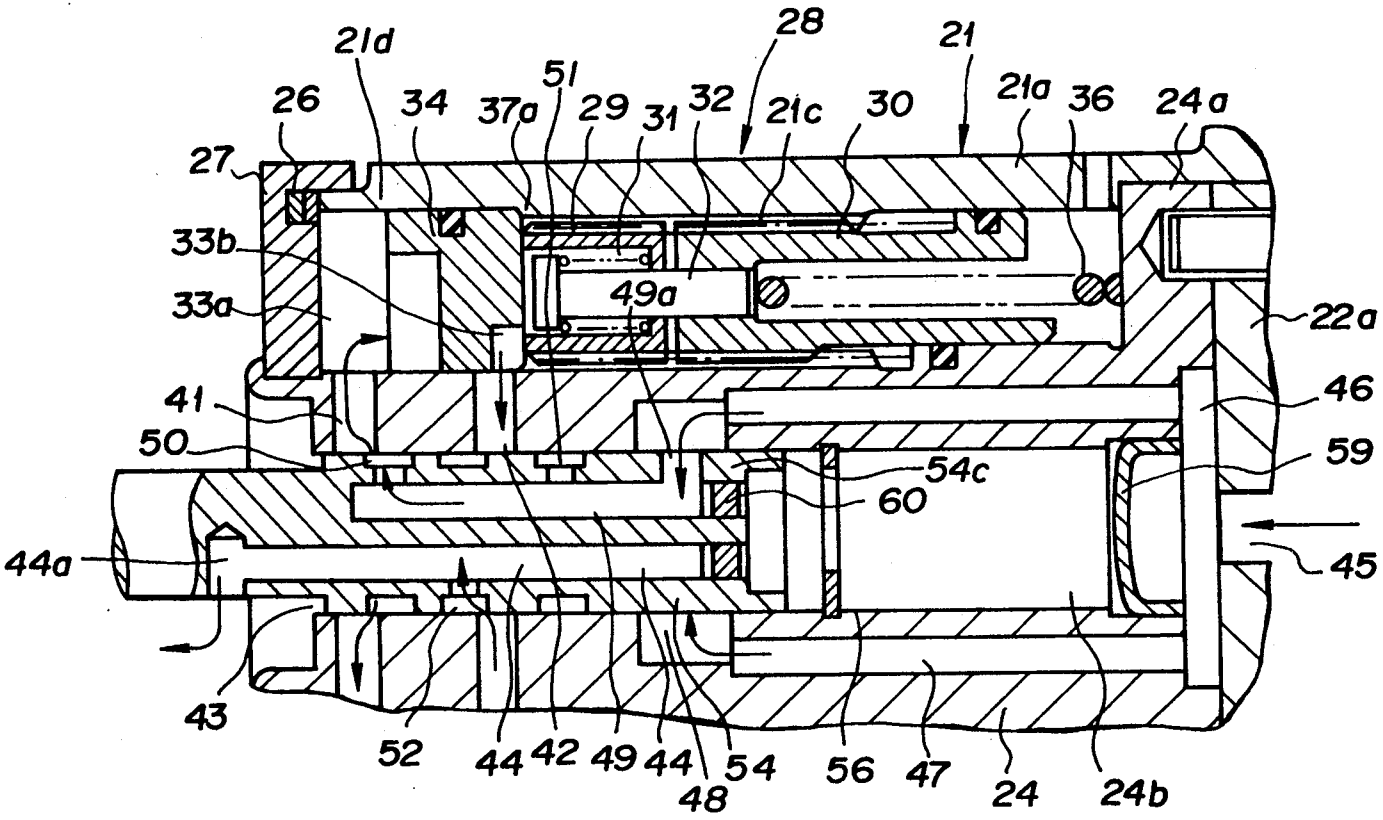
FIG. 4 is an enlarged fragmentary view of FIG. 3.

When the engine load increases to a medium level, the controller 58 transmits ON signal to the coil 55*b*. The actuator 55 is energized to retract the valve spool 54 so that the valve spool 54 moves leftward up to a predetermined intermediate spool position as seen in FIGS. 3 and 4. At the intermediate spool position, the groove 50 of the supply passage 49 communicates with the first chamber 33*a* via the first radial bore 41 while the groove 52 of the drain passage 44 communicates with the second chamber 33*b* via the second radial bore 42. The hydraulic fluid in the second chamber 33*b* is discharged through the drain opening 44*a* of the drain passage 44 so that the hydraulic pressure in the second chamber 33*b* is reduced. On the other hand, the hydraulic fluid fed into the main supply bore 40 is introduced into the first chamber 33*a*, via the axial bore 45, the central shallow bore 46, the passage 47, the inner annular bore 48, the supply passage 49, the groove 50 and the first radial bore 41. Accordingly, the hydraulic pressure in the first chamber 33*a* is increased so that the floating piston 34 moves axially and rearward (rightward) until it stops at the shoulder 37*a* of the timing sprocket 21. Owing to the axial and rearward movement of the floating piston 34, the helical piston assembly 28 is urged rearward to move up to a predetermined intermediate piston position as seen in FIGS. 3 and 4. At the intermediate piston position, the angular phase relationship between the timing sprocket 21 and the camshaft 22 is medium which is larger than that under the low engine load condition. As a result, the valve close timing becomes faster than that under the low engine load condition.

Figure 5:
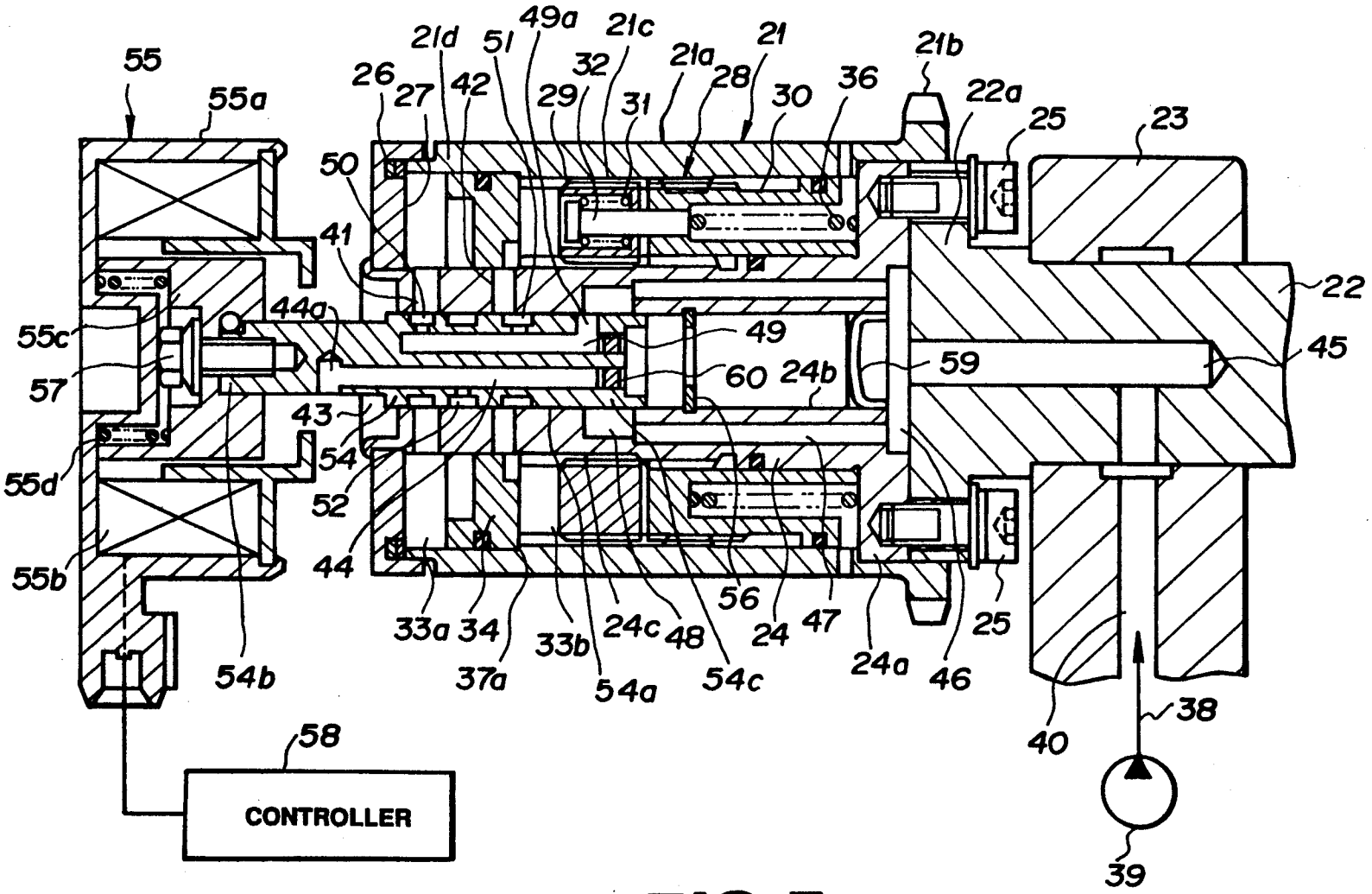
FIG. 5 is an enlarged section of the valve timing control system, showing an operational state with high engine load.
Figure 6:
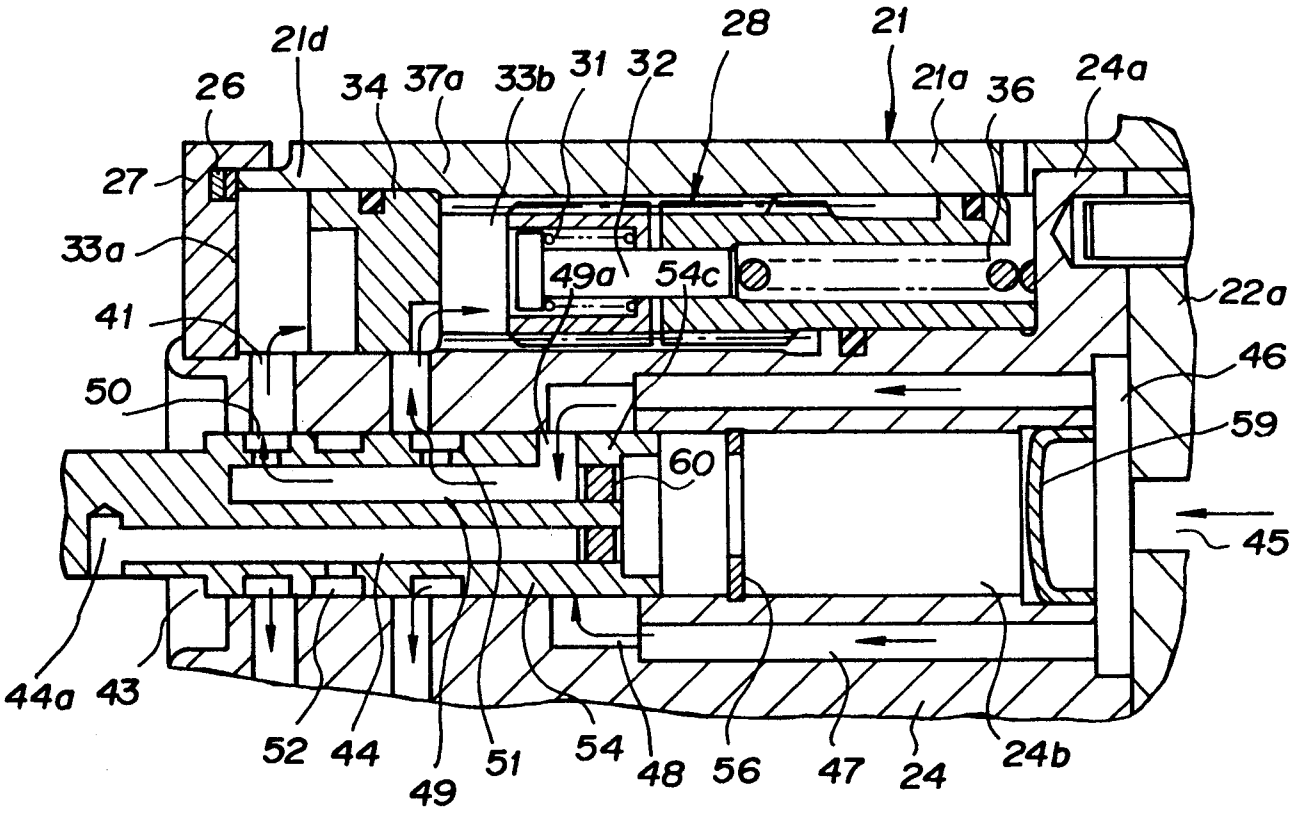
FIG. 6 is an enlarged fragmentary view of FIG. 5.

When the engine load increases up to a high level, the actuator 55 receives from the controller 58 a control signal such that the actuator 55 further retracts the valve spool 54. The valve spool 54 axially moves to the left-most position as shown in FIGS. 5 and 6. At the left-most position, the grooves 50 and 51 of the supply passage 49 communicates with the first and second radial bores 41 and 42 of the sleeve 24. The first and second radial bores 41 and 42 communicate with the first and second chambers 33*a* and 33*b*. Accordingly, the hydraulic fluid fed into the main supply bore 40 is introduced into both of the first and second chambers 33*a* and 33*b*. The hydraulic pressure in the second chamber 33*b* is momentarily increased so that the helical piston assembly 28 is urged against the force of the coil spring 36 to move axially and rearward (rightward viewing in FIGS. 5 and 6) until the gear element 30 abuts against the flange 24*a* of the sleeve 24. Therefore, the angular phase relationship between the timing sprocket 21 and the camshaft 22 is maximum which is larger than that at the medium engine load level. The valve close timing becomes faster than that at the medium engine load level.

As is appreciated from the above description, the angular phase relationship between the timing sprocket 21 and the camshaft 22 is also adjustable quickly when the engine load varies from the high level to the medium level.

What is claimed is:

1. A valve timing control system comprising:

a timing sprocket including a cylindrical body;

a camshaft;

a sleeve secured to said camshaft and disposed in said cylindrical body and cooperating therewith to define an annular space therebetween;

a helical piston assembly movably disposed in said annular space;

a floating piston movably disposed in said annular space;

an end plug closing one end of said annular space;

said floating piston and said end plug cooperating with each other to define therebetween a first chamber in said annular space;

said floating piston and said piston assembly cooperating with each other to define therebetween a second chamber in said annular space;

means for causing said sleeve to vary an angular position thereof relative to said cylindrical body in response to movement of said helical piston assembly;

a hydraulic fluid pump;

a valve spool movably disposed in said sleeve, said valve spool having a first position wherein said first and second chambers are drained, a second position wherein said first chamber is allowed to communicate with said hydraulic fluid pump to be supplied with pressurized hydraulic fluid and said second chamber is drained, and a third position wherein said first and second chambers are allowed to communicate with said hydraulic fluid pump to be supplied with the pressurized hydraulic fluid; and an actuator operatively connected to said valve spool for movement of said valve spool among said first, second and third positions.

2. A valve timing control system as claimed in claim 1, wherein said actuator is a solenoid operated actuator of a current proportional type in which said valve spool moves in proportion to electrical current supplied to said solenoid operated actuator.

* * * * *